US005169325A

United States Patent [19]

Yaegashi et al.

[11] Patent Number: 5,169,325

[45] Date of Patent: Dec. 8, 1992

[54] COAXIAL RIBBON CABLE CONNECTOR

[75] Inventors: Hirokatsu Yaegashi; Tadahiro Fumikura, both of Tokyo, Japan

[73] Assignee: Hirose Electric Co., Ltd., Tokyo, Japan

[21] Appl. No.: 850,308

[22] Filed: Mar. 12, 1992

[30] Foreign Application Priority Data

Mar. 12, 1991 [JP] Japan ..... 3-21275[U]

[51] Int. Cl.[5] ..... H01R 13/658

[52] U.S. Cl. ..... 439/108; 439/608; 439/581

[58] Field of Search ..... 439/108, 494, 497, 499, 439/607, 608, 578, 581

[56] References Cited

U.S. PATENT DOCUMENTS 4,558,917 12/1985 Kamono et al. ..... 439/608
4,984,992 1/1991 Beamenderfer et al. ..... 439/108

FOREIGN PATENT DOCUMENTS 8707444 12/1987 European Pat. Off. ..... 439/608
0337634 10/1989 European Pat. Off. ..... 439/608

*Primary Examiner*—Eugene F. Desmond
*Attorney, Agent, or Firm*—Kanesaka & Takeuchi

[57] ABSTRACT

A coaxial ribbon cable connector consisting of a cable-side connector (2) and a board-side connector (3). The cable-side connector includes an insulating case (4); a plurality of signal terminals (8) to which signal lines of a coaxial cable are to be connected; a plurality of ground terminals (9) to which drain lines of the cable are to be connected; and a plurality of shield terminals (10) disposed between the signal terminals. The board-side connector includes an insulating case (33); a plurality of signal terminals (43) arranged within the insulating case for contact with the signal terminals of the cable-side connector; a plurality of ground terminals (44) arranged within the insulating case for contact with the ground terminals of the cable-side connector; a plurality of shield terminals (45) arranged within the insulating case for contact with the shield terminals of the cable-side connector; and terminal legs of the signal and ground terminals being arranged in parallel to form a microstrip line.

1 Claim, 21 Drawing Sheets

COAXIAL RIBBON CABLE CONNECTOR

BACKGROUND OF THE INVENTION

1. Field of the Invention

The present invention relates to coaxial ribbon cable connectors of the lateral mount type.

2. Description of the Prior Art

FIGS. 42 and 43 show a conventional board-side connector of a coaxial ribbon cable connector of this type. The board-side connector includes an insulation case 90 which has a fitting cavity 91 on the front face for receiving a cable-side connector. Signal terminals 92 and ground terminals 93 are arranged such that their contact portions 92*a* and 93*a* face each other. The terminal legs 92*b* and 93*b* of the terminals 92 and 93 are bent at right angles so that the distance between the signal and ground terminals at the bend is very large.

In the above conventional connector, the distance between the signal and ground terminals is so large that it is impossible to control impedance and bring the impedance close to the cable impedance. In addition, there is no shield between the signal terminals 92 so that it is impossible to prevent crosstalk between signals.

SUMMARY OF THE INVENTION

Accordingly, it is an object of the invention to provide a coaxial ribbon cable connector which permits to control the impedance and bring the impedance close to the cable impedance.

It is another object of the invention to provide a coaxial ribbon cable connector which is free of crosstalk between signals.

According to the invention there is provided a coaxial ribbon cable connector consisting of a cable-side connector and a board-side connector.

The cable-side connector includes an insulating case; a plurality of signal terminals to which signal lines of a coaxial cable are to be connected; a plurality of ground terminals to which drain lines of the cable are to be connected; and a plurality of shield terminals disposed between the signal terminals.

The board-side connector includes an insulating case; a plurality of signal terminals arranged within the insulating case for contact with the signal terminals of the cable-side connector; a plurality of ground terminals arranged within the insulating case for contact with the ground terminals of the cable-side connector; a plurality of shield terminals arranged within the insulating case for contact with the shield terminals of the cable-side connector; and terminal legs of the signal and ground terminals being arranged in parallel to form a microstrip line.

The above and other objects, features, and advantages of the invention will be apparent from the following description when taken in conjunction with the accompanying drawings.

DESCRIPTION OF THE PREFERRED EMBODIMENT

Figure 1:
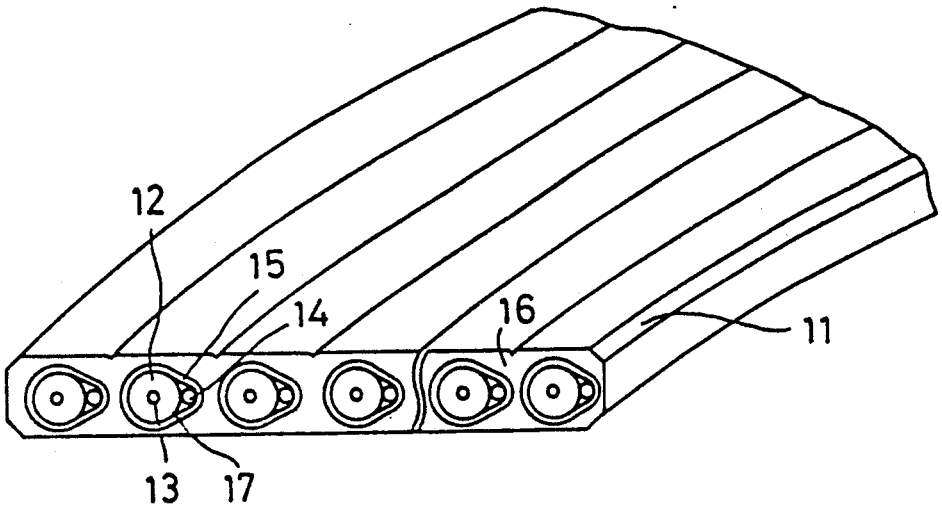
FIG. 1 is a perspective view of a coaxial ribbon cable.

In FIG. 1, a coaxial ribbon cable Il includes an insulating jacket 16 and a number of shielded wires arranged side by side in the insulating jacket 16, with each made up of a signal line 17 which is composed of a central conductor 13 and a dielectric member 12 for coating the central conductor 13; a drain line 14; and a copper foil 15 for wrapping the signal and drain lines together. Generally, a coaxial ribbon cable connector consists of a cable-side connector and a board-side connector.

Figure 2:
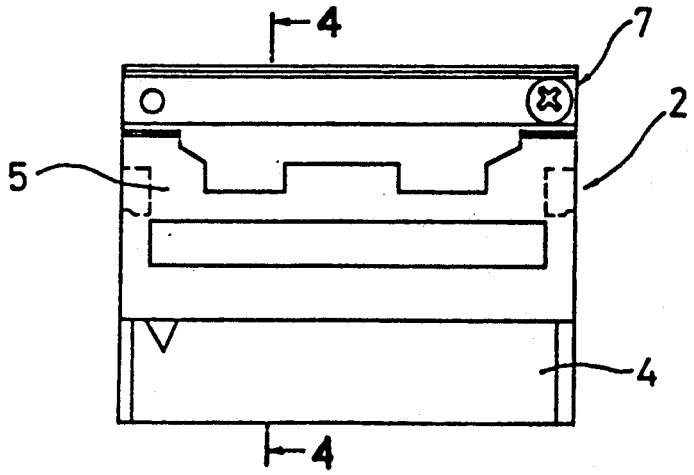
FIG. 2 is a top plan view of a cable-side connector for a coaxial ribbon cable connector according to an embodiment of the invention.
Figure 3:
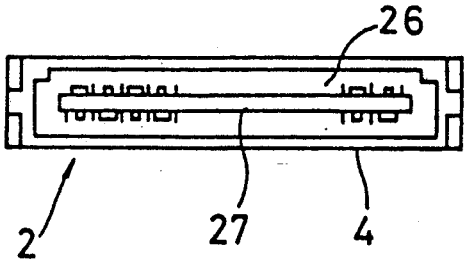
FIG. 3 is a front elevational view of the cable-side connector.
Figure 4:
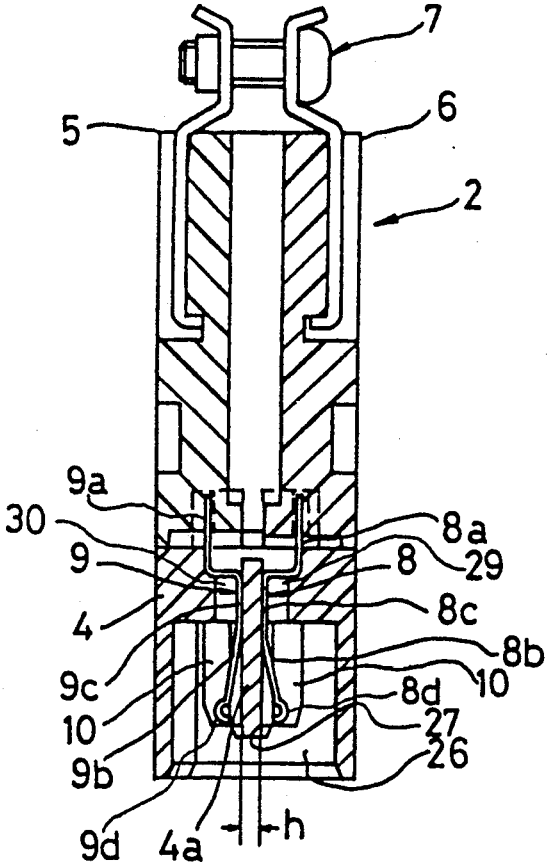
FIG. 4 is a sectional view taken along line 4—4 of FIG. 2.
Figure 5:
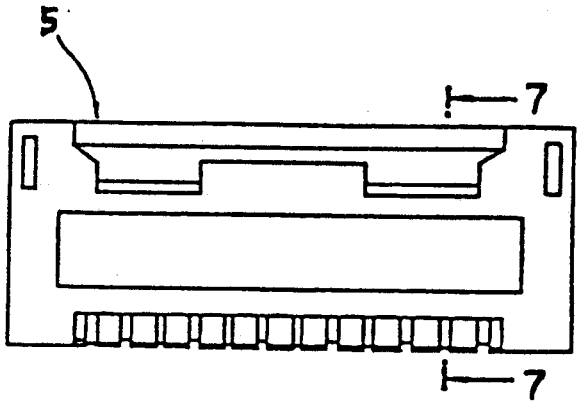
FIG. 5 is a top plan view of a left-hand cover member of the cable-side connector.
Figure 6:
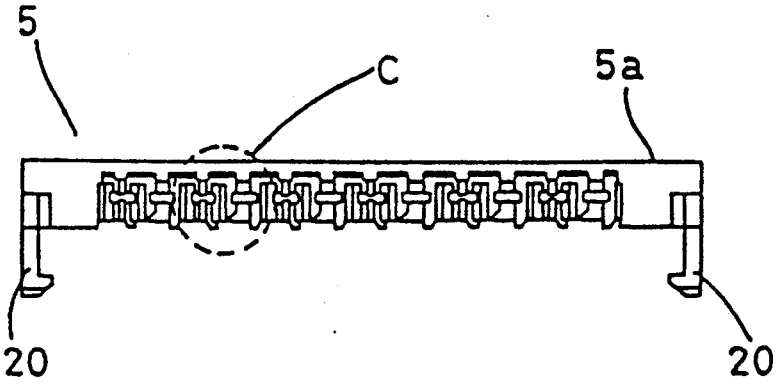
FIG. 6 is a front elevational view of the left-hand cover member.
Figure 7:
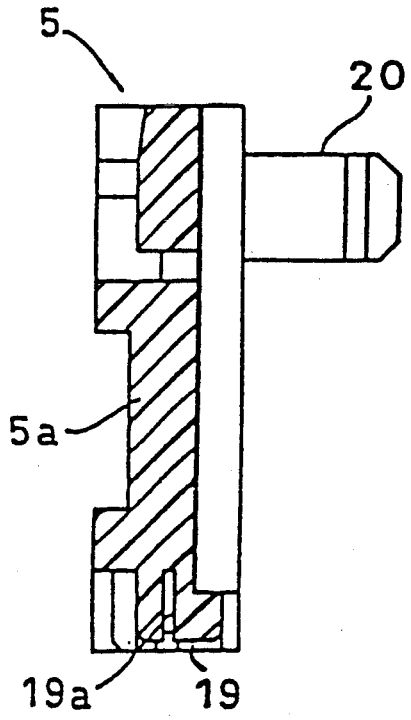
FIG. 7 is a sectional view taken along line 7—7 of FIG. 5.
Figure 8:
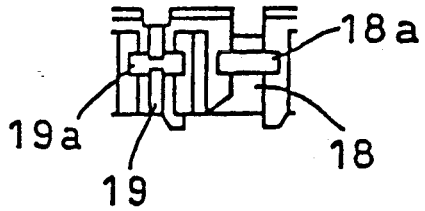
FIG. 8 is an enlarged view of a portion C of FIG. 6.
Figure 9:
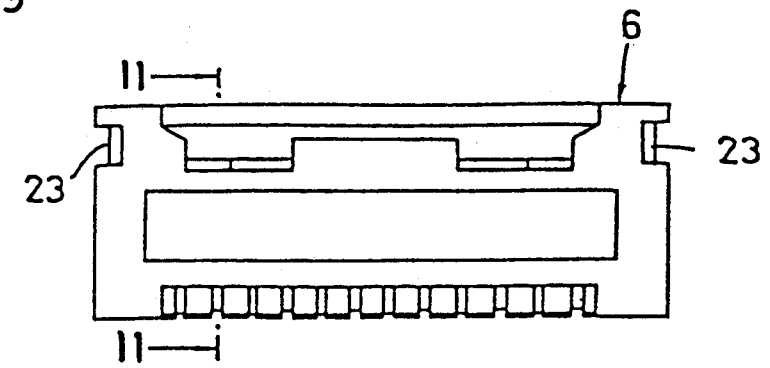
FIG. 9 is a top plan view of a right-hand cover member of the cable-side connector.
Figure 10:
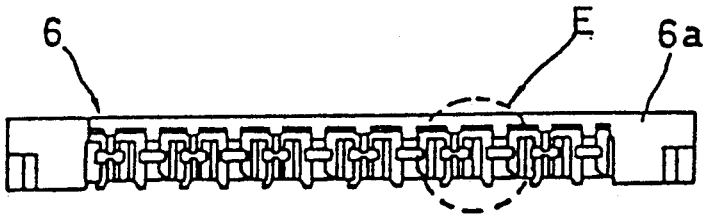
FIG. 10 is a front elevational view of the right-hand cover member.
Figure 11:
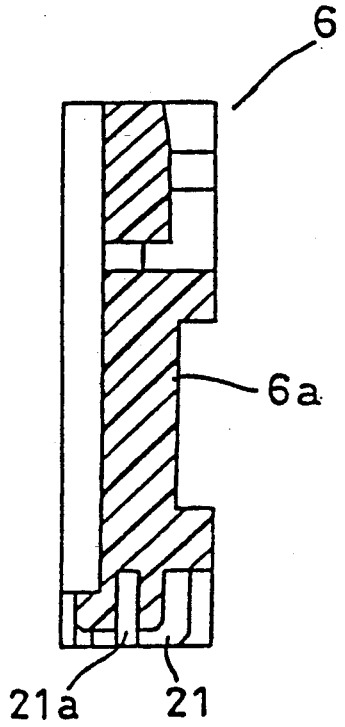
FIG. 11 is a sectional view taken along line 11—11 of FIG. 9.
Figure 12:
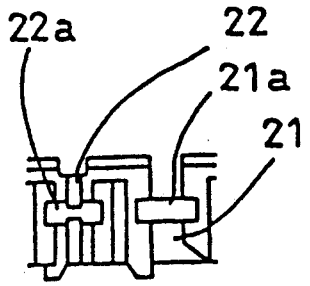
FIG. 12 is an enlarged view of a portion E of FIG. 10.
Figure 13:
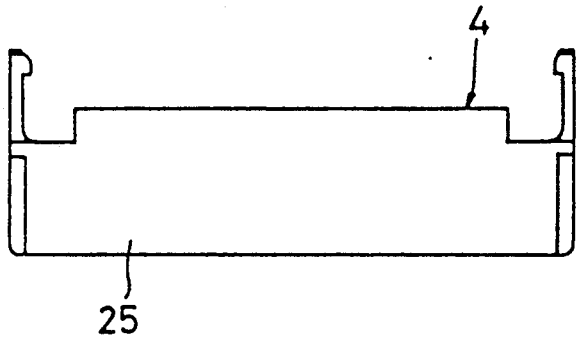
FIG. 13 is a top plan view of an insulating case of the cable-side connector.
Figure 14:
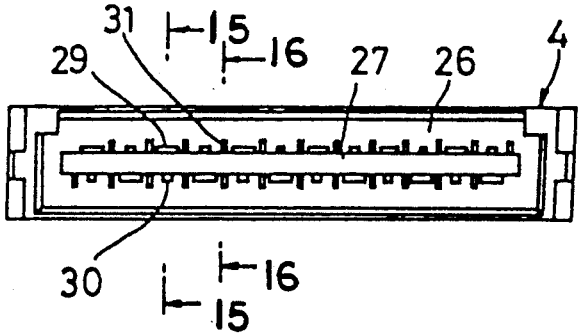
FIG. 14 is a front elevational view of the insulating case.
Figure 15:
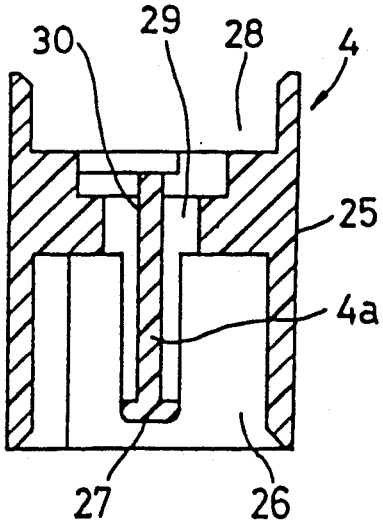
FIG. 15 is a sectional view taken along line 15—15 of FIG. 14.
Figure 16:
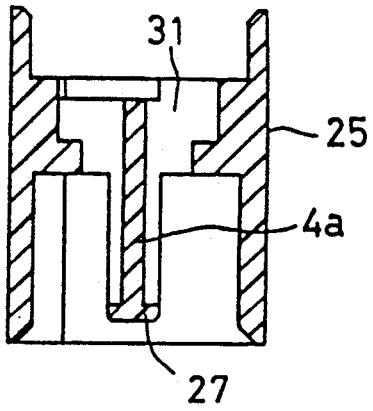
FIG. 16 is a sectional view taken along line 16—16 of FIG. 14.

In FIGS. 2–4, a cable-side connector 2 consists of an insulating case 4; a pair of cover members 5 and 6, a clamp member 7; and signal terminals 8, ground terminals 9, and shield terminals 10, all of which are arranged in the insulating case 4 as shown.

In FIGS. 5–8, a left-hand cover member 5 includes a rectangular resin block 5*a* which has signal line engaging grooves 18 and drain line engaging grooves 19 formed alternatingly on the front end. Terminal receiving apertures 18*a* and 19*a* are formed the signal and drain line engaging grooves 18 and 19, respectively. A pair of latch arms 20 extend toward a mating cover member from the opposite end portions of the cover member 5*a*.

In FIGS. 9–12, a right-hand cover member 6 includes a rectangular resin block 6*a* which has signal line engaging grooves 21 and drain lie engaging grooves 22 formed alternatingly on the front end. Terminal receiving apertures 21*a* and 22*a* are formed in the signal and drain line grooves, respectively. A pair of latch shoulders 23 are formed on opposite ends of the cover member 6*a*.

A length of insulation jacket 16 is removed to expose shield wires 17. The latch arms 20 of the left-hand cover member 5 are locked with the latch shoulders 23 of the right-hand cover member 6 to hold the coaxial ribbon cable 11 between the cover members 5 and 6, with the copper foil 15 peeled off. Consequently, the signal line engaging grooves 18 and 21 correspond to the drain line engaging grooves 22 and 19, respectively, and the signal line 17 and the drain line 14 of a shielded wire are bent along the signal line engaging groove 18 and the drain line engaging groove 22 while the signal line 17 and the drain line 14 of another shield wire are bent along the signal line engaging groove 21 and the drain line engaging groove 19, respectively. Thus, the signal lines 17 and the drain lines 14 are arranged alternatingly along the length of the cover members 5 and 6.

In FIGS. 13–16, the insulating case 4 includes a rectangular resin block 25 which has a rectangular fitting cavity 26 on the front face and a terminal support 27 extending along the length of the fitting cavity 26. A rectangular recess 28 is formed on the rear face of the resin block 25. Signal terminal mount apertures 29 and ground terminal mount apertures 30 are formed in the rectangular recess 28 on opposite sides of the terminal support 27. The signal terminal mount apertures 29 and the ground terminal mount apertures 30 are arranged alternatingly at regular intervals along the length of the resin block 25. Shield terminal mount apertures 31 are formed in the rectangular recess 26 between pairs of corresponding signal terminal mount aperture 29 and ground terminal mount aperture 20 and extend across the terminal support 27.

The signal terminals 8, the ground terminals 9, and the shield terminals 10 are mounted in the signal terminal mount apertures 29, the ground terminal mount apertures 20, and the shield terminal mount apertures 31, respectively. More specifically, the signal terminals 8 are mounted in the insulating case 4 by press-fitting the press-fit portion 8*c* into the signal terminal mount aperture 29 such that the connection portion 8*a* of the insulation-displacement type extends upwardly into the rectangular recess 26 while the straight portion 8*b* extends along the terminal support 27.

The ground terminal 9 is mounted in the insulating case 4 by press-fitting the press-fit portion 9*c* into the ground terminal mount aperture 30 such that the connection portion 9*a* of the insulation-displacement type projects into the rectangular recess 26 while the straight portion 9*b* extends along the terminal support 27. Consequently, there is provided a partition wall 4*a* having a thickness h between the straight portions 8*b* and 9*b* of the signal terminal 8 and the ground terminal 9 as shown in FIG. 4. In other words, the straight portions 8*b* and 9*b* of the signal and ground terminals 8 and 9 are disposed in a back-to-back relationship across the partition wall 4*a* to form a microstrip line between the signal and ground terminals.

Figure 17:
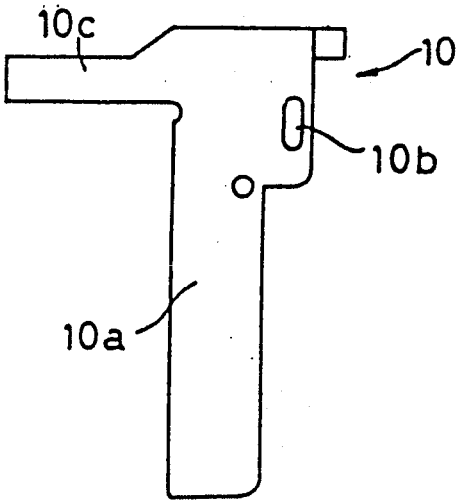
FIG. 17 is a side elevational view of a first shield terminal.
Figure 18:
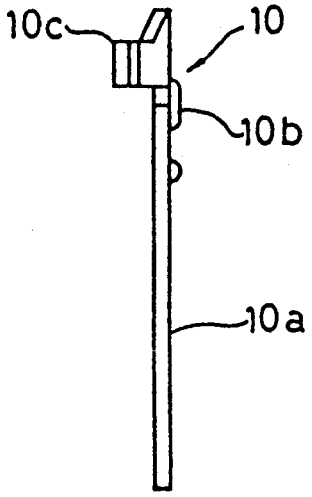
FIG. 18 is a front elevational view of the first shield terminal.
Figure 19:
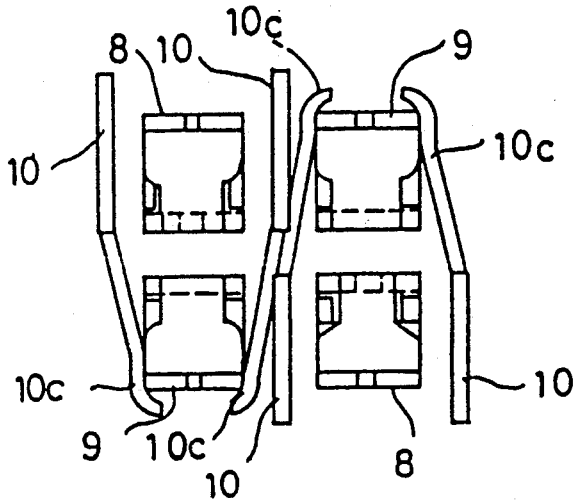
FIG. 19 shows how various terminals are arranged in the cable connector.
Figure 20:
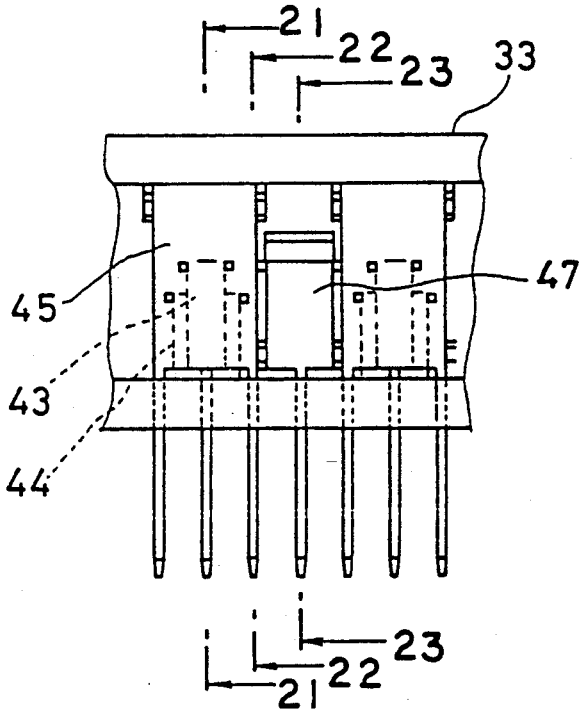
FIG. 20 is a rear elevational view of a part of a board-side connector according to an embodiment of the invention.

In FIGS. 17 and 18, the shield terminal 10 includes a flat shield portion 10*a*, a press-fit portion 10*b*, and a short-circuit portion 10*c* extending from the press-fit portion 10*b* at right angles to the shield portion 10*a*. The shield terminal 10 is mounted by press-fitting the press-fit portion 10*b* into the shield terminal mount aperture 31 such that the short-circuit portions 10*c* are brought into contact with the ground terminals 9 while the shield terminals 10 are disposed between the signal terminals 8 to prevent crosstalk between the signal terminals 8 as shown in FIG. 19.

The cable connector 2 is completed by fitting the insulating case 4, in which the respective terminals 8, 9, and 10 are mounted, into the cover members 5 and 6 to connect by insulating displacement the signal lines 17 and the drain lines 14 to the connection portions 8*a* and 9*a* of the signal terminals 8 and ground terminals 9, respectively.

In FIGS. 20–23, the board-side connector 3 is of the lateral mount shield type and is composed of an insulating case 33 and signal terminals 43, ground terminals 44, and shield terminals 45 arranged as shown. The insulating case 33 includes a rectangular resin block 37 which has a rectangular fitting cavity 38 on the front face. A locator 37*a* extends backwardly from the lower rear face of the resin block 37, providing a mount face 37*b*. Signal terminal mount apertures 39*a* and ground terminal mount apertures 40*a* are alternatingly formed on the upper portion of the fitting cavity 38 along the length of the cavity such that the signal terminal mount aperture 39*a* and the ground terminal mount aperture 40*b* face each other while the ground terminal mount aperture 40*a* and the signal terminal mount aperture 39*b* face each other. Shield terminal mount apertures 41*a* and 41*b* are formed outside the signal terminal mount apertures 39*a* and 39*b* and the ground terminal mount apertures 40*a* and 40*b*, respectively. A pair of terminal grooves 42 are formed on opposite sides of each shield terminal mount aperture 41*a* and 41*b*.

First signal terminals 43, first ground terminals 44, and first shield terminals 45 are mounted in the signal terminal mount apertures 39*s*, the ground terminal mount apertures 40*b*, and the shield terminal mount apertures 41*a*, respectively, while second signal terminals 46, second ground terminals 47, and second shield terminals 48 are mounted in the signal terminal mount apertures 39*b*, the ground terminal mount apertures 40*a*, and the shield terminal mount apertures 41*b*, respectively.

Figure 24:
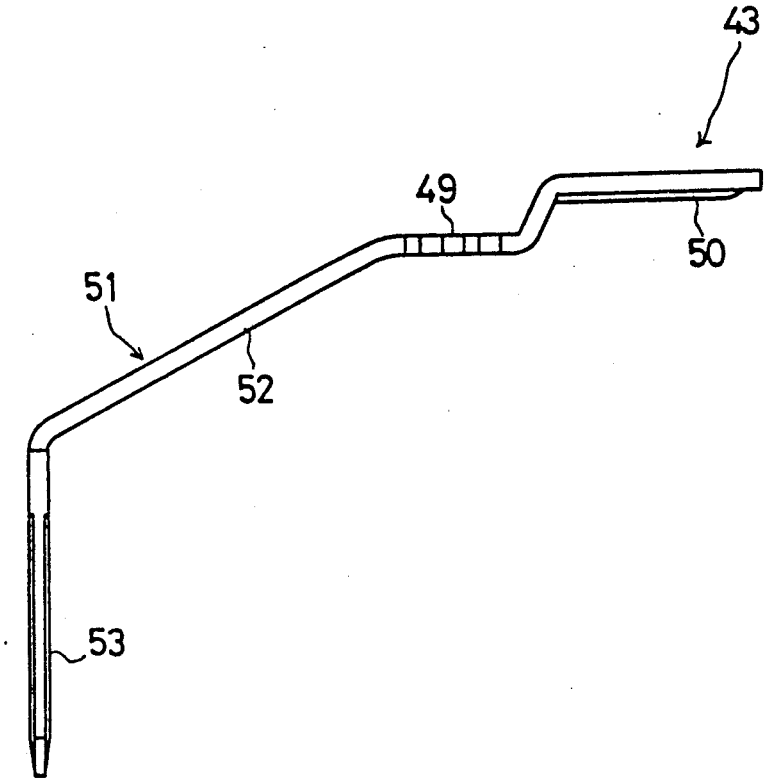
FIG. 24 is a side elevational view of a first signal terminal for the board-side connector.
Figure 25:
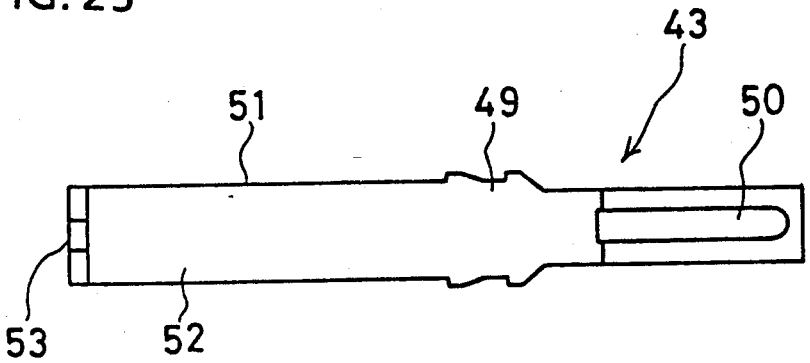
FIG. 25 is a bottom plan view of the first signal terminal.

In FIGS. 24 and 25, the first signal terminal 43 has a press-fit portion 49, a contact portion 50 extending forward from the press-fit portion 49, and a terminal leg 51 extending rearwardly from the press-fit portion 49. The terminal leg 51 has a sloped portion 52 and a through-hole mount portion 53 which extends in a direction perpendicular to the press-fit portion 49.

Figure 26:
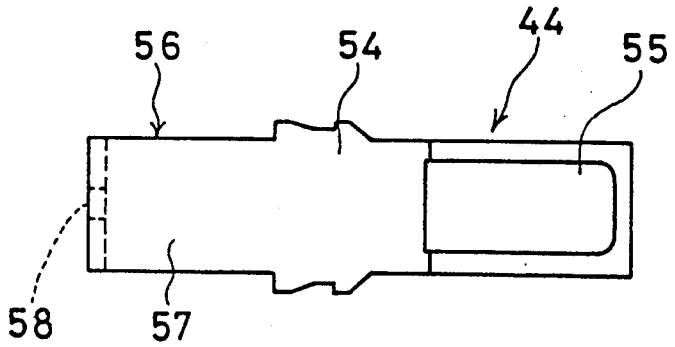
FIG. 26 is a top plan view of a first ground terminal for the board-side connector.
Figure 27:
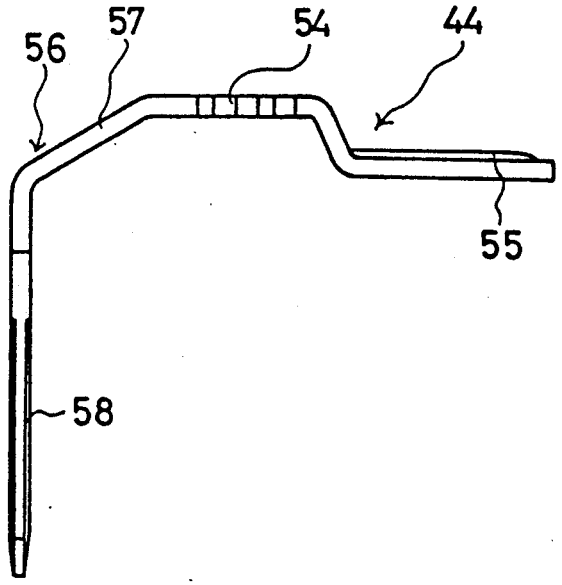
FIG. 27 is a side elevational view of the first ground terminal.

In FIGS. 26 and 27, the first ground terminal 44 has a press-fit portion 54, a contact portion 55 extending forwardly from the press-fit portion 54, and a terminal leg 56 extending rearwardly from the press-fit portion 54. The terminal leg 54 has a sloped portion 57 and a through-hole mount portion 58 extending in a direction perpendicular to the press-fit portion 54. The width of the first ground terminal 44 is larger than that of the first signal terminal 43.

Figure 28:
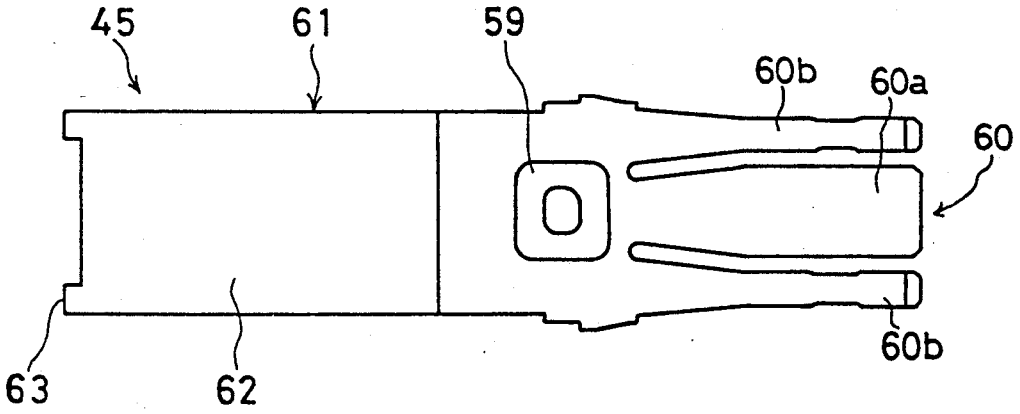
FIG. 28 is a top plan view of a first shield terminal for the board-side connector.
Figure 29:
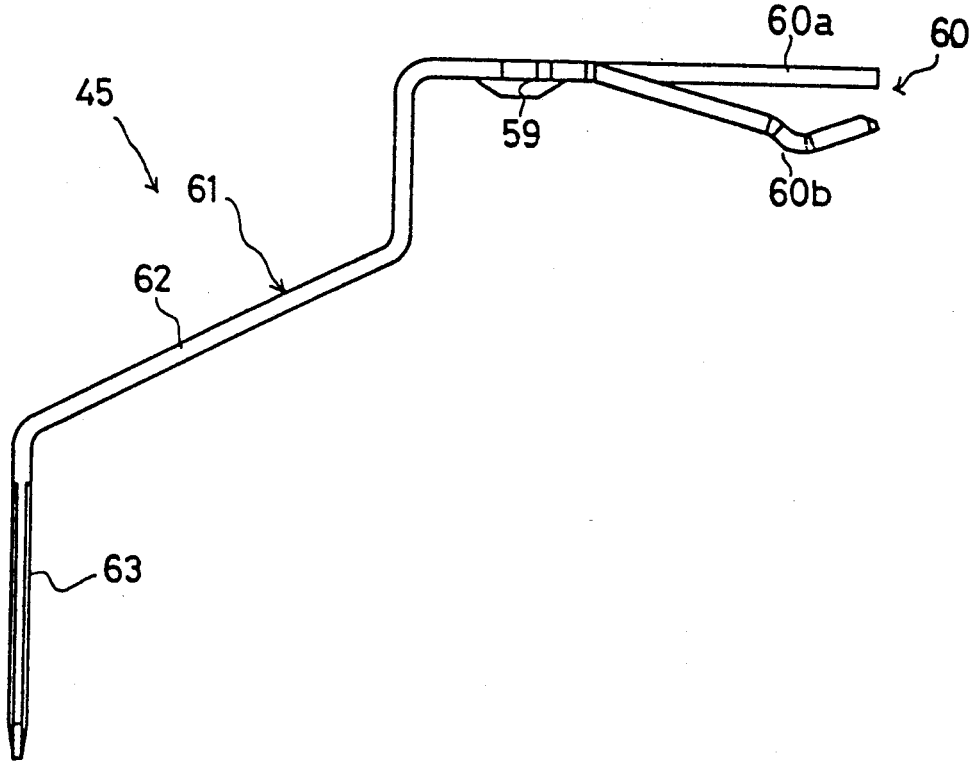
FIG. 29 is a side elevational view of the first shield terminal.

In FIGS. 28 and 29, the first shield terminal 45 includes a press-fit portion 59, a contact portion 60 extending forwardly from the press-fit portion 59, a terminal leg 61 extending rearwardly from the press-fit portion 59. The contact portion 60 has a retention member 60*a* and a pair of contact members 60*b* on opposite sides of the retention member 60*a*. Each contact member 60*b* is bent in the free end portion. The terminal leg 61 has a sloped portion 62 which extends downwardly and then obliquely from the press-fit portion 59 and a through-hole mount portion 63 which extends downwardly from the sloped portion 62. The width of the first shield terminal 45 is larger than that of the first ground terminal 45.

Figure 30:
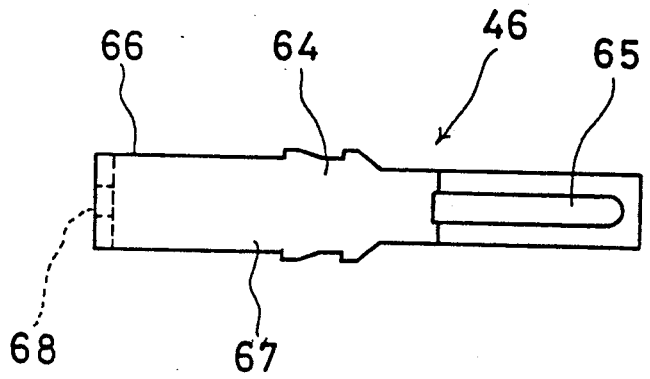
FIG. 30 is a top plan view of a second signal terminal for the board-side connector.
Figure 31:
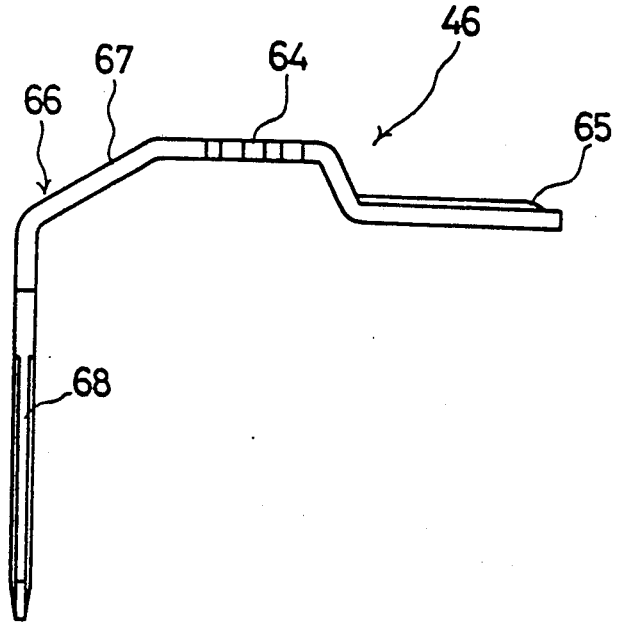
FIG. 31 is a side elevational view of the second signal terminal.

In FIGS. 30 and 31, the second signal terminal 46 has a press-fit portion 64, a contact portion 65 extending forwardly from the press-fit portion 64, and a terminal leg 66 extending rearwardly from the press-fit portion 64. The terminal leg 66 has a sloped portion 67 and a through-hole mount portion 68 extending downwardly from the sloped portion 67.

Figure 32:
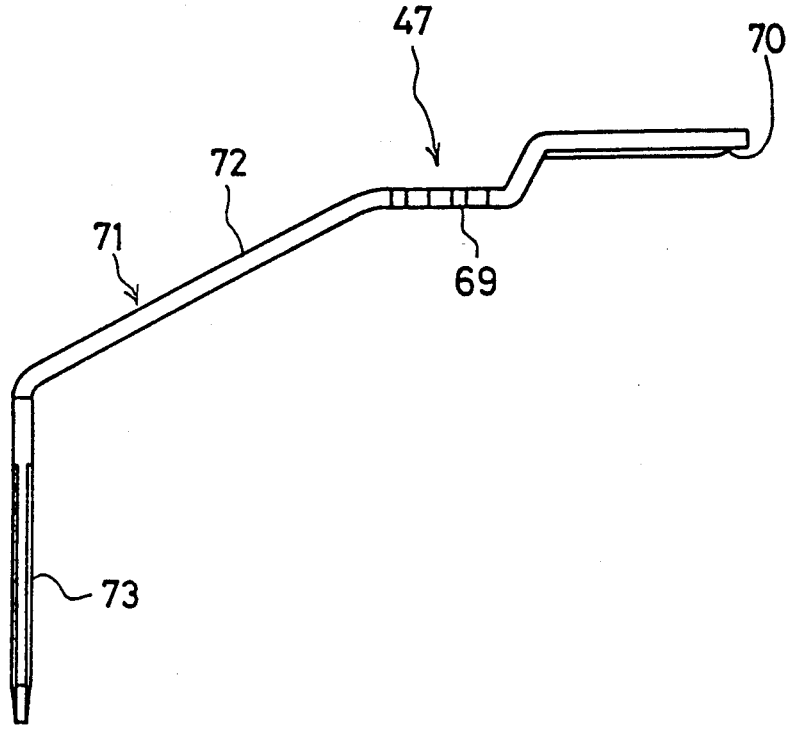
FIG. 32 is a side elevational view of a second ground terminal of the board-side connector.
Figure 33:
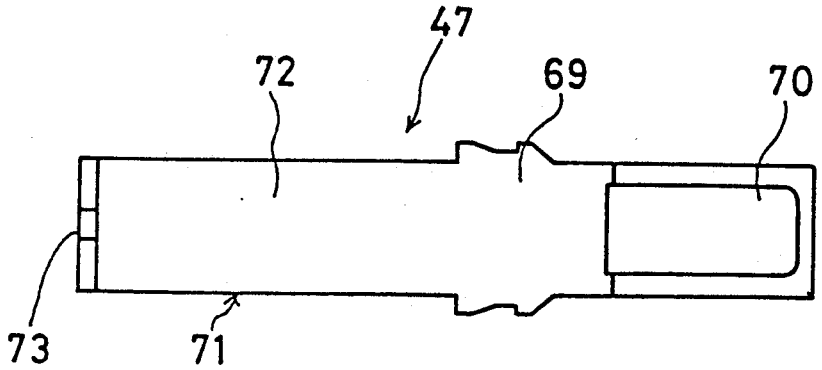
FIG. 33 is a bottom plan view of the second ground terminal.

In FIGS. 32 and 33, the second ground terminal 47 has a press-fit portion 69, a contact portion 70 extending forwardly from the press-fit portion 69, and a terminal leg 71 extending rearwardly from the press-fit portion 69. The terminal leg 71 has a sloped portion 72 and a through hole mount portion 73 extending downwardly from the sloped portion 72. The width of the second ground terminal 47 is equal to that of the first ground terminal 44.

Figure 34:
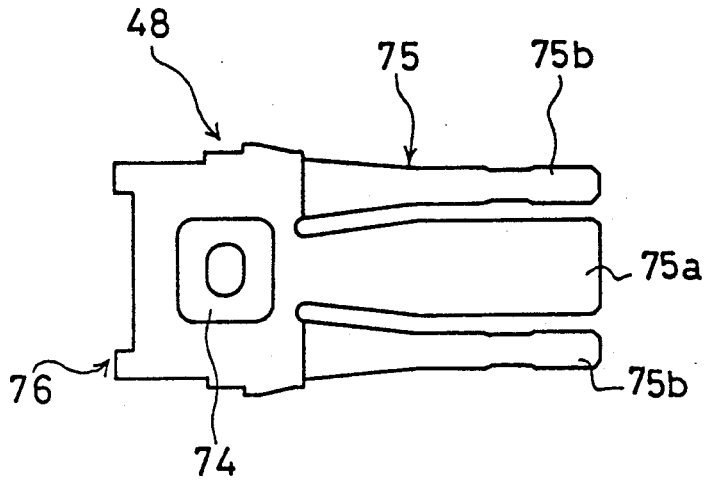
FIG. 34 is a top plan view of a second shield terminal of the board-side connector.
Figure 35:
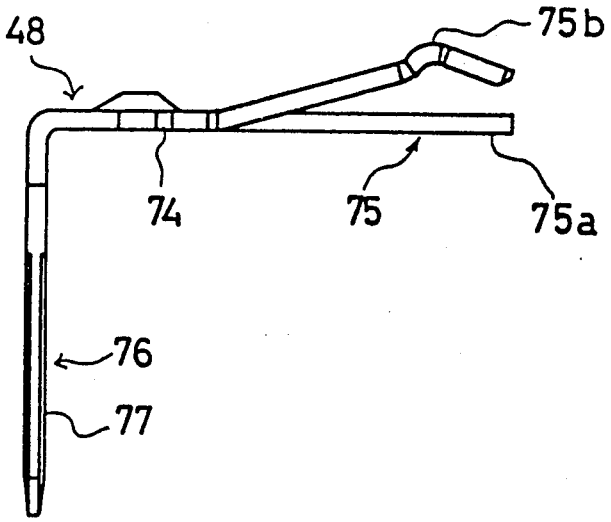
FIG. 35 is a side elevational view of the second shield terminal.

In FIGS. 34 and 35, the second shield terminal 48 has a press-fit portion 74, a contact portion 75 extending forwardly from the press-fit portion 74, and a terminal leg 76 extending downwardly from the press-fit portion 74. The contact portion 75 has a retention member 75*a* and a pair of contact members 75*b* formed on opposite sides of the retention member 75*a*. Each contact member 75*b* is curved in the free end portion. The terminal leg 76 has a through-hole mount portion 77 in the free end portion. The width of the second shield terminal 48 is equal to that of the first shield terminal 60.

The first signal terminal 43, the first ground terminal 44, and the first shield terminal 45 are mounted in the insulating case 4 by press-fitting the press-fit portions 49, 54, and 59 into the signal terminal mount aperture 39*a*, the ground terminal mount aperture 40*b*, and the shield terminal mount aperture 41*a* such that the respective through-hole mount portions 53, 58, and 63 of the terminal legs 51, 56, and 61, are inserted into the mount apertures 37*c* of the locator member 37*a*. Consequently, the contact members of the shield terminal 45 are inserted in the terminal grooves 45*a* on opposite sides of the shield terminal mount aperture 45.

Figure 21:
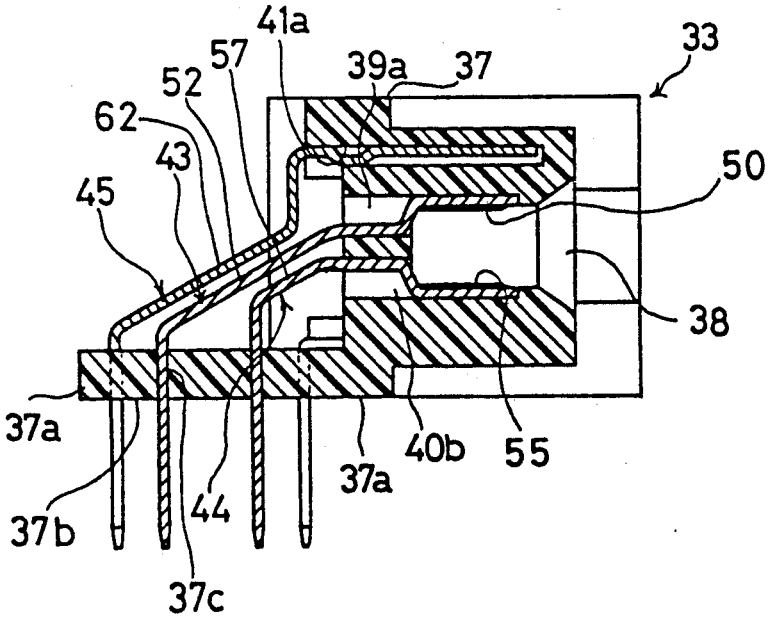
FIG. 21 is a sectional view taken along line 21—21 of FIG. 20.

When the first signal terminal 43, the ground terminal 44, and the shield terminal 45 are mounted in the insulating case 33, the respective terminal legs 51, 56, and 61 of the terminals 43, 44, and 45 are parallel to each other in the sloped portions 52, 57, and 62, with the sloped portion 62 of the shield terminal 45 disposed outside the sloped portion 52 of the signal terminal 43 while the sloped portion 57 of the ground terminal 44 disposed inside the sloped portion 52 of the signal terminal 43. At the same time, the terminal legs 51 and 56 of the signal terminal 43 and the ground terminal 44 form a strip-line configuration in the sloped portions 52 and 54 as shown in FIG. 21.

Figure 22:
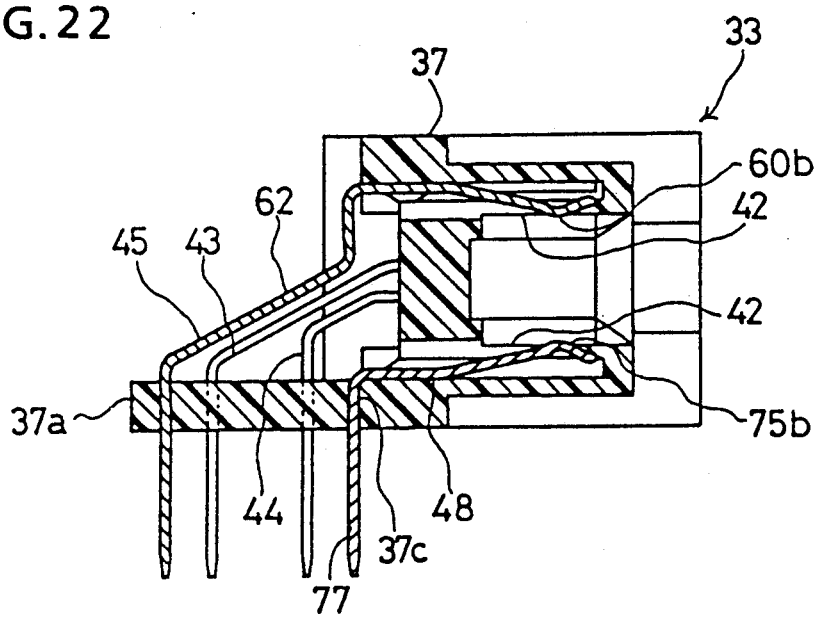
FIG. 22 is a sectional view taken along line 22—22 of FIG. 20.
Figure 23:
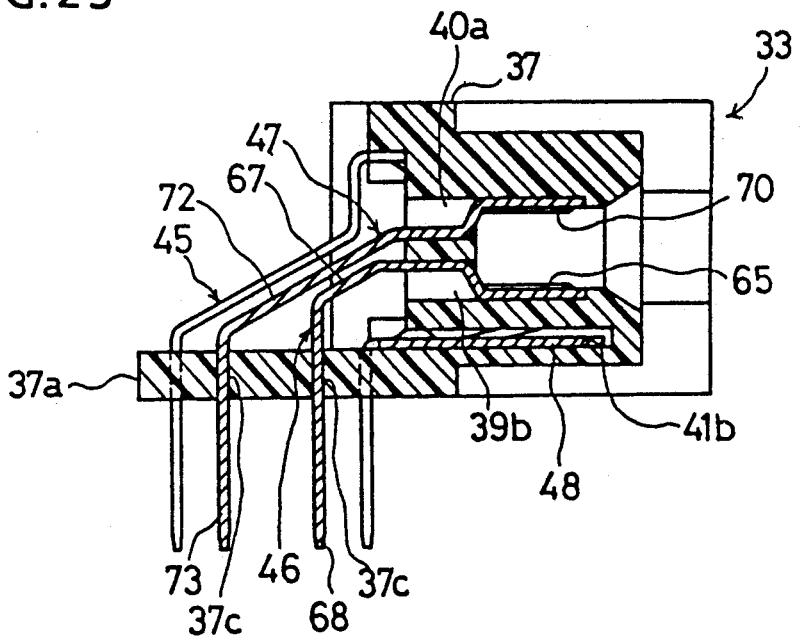
FIG. 23 is a sectional view taken along line 23—23 of FIG. 20.

The second signal terminal 46, the second ground terminal 47, and the second shield terminal 48 are mounted in the insulating case 33 by press-fitting the press-fit portions 68, 69, and 74 into the signal terminal mount aperture 39*b*, the ground terminal mount aperture 40*a*, and the shield terminal mount aperture 41*b* such that the respective through-hole mount portions 68, 73, and 77 of the terminal legs 66, 71, and 76 are inserted into the mount apertures 37*c* of the locator member 37*a*. Consequently, the contact members 75*a* and 75*b* of the shield terminal 48 are inserted in the terminal grooves 42 on opposite sides of the shield terminal mount aperture 41*b* as shown in FIG. 22.

When the second signal terminal 46, the ground terminal 47, and the shield terminal 48 are mounted in the insulating case 33, the respective terminal legs 66 and 71 of the signal and ground terminals 46 and 47 are parallel to each other in the sloped portions 67 and 72. At the same time, the terminal legs 66 and 71 of the second signal and ground terminals 46 and 47 form a strip-line configuration in the sloped portions 67 and 72.

The board-side connectors 3 is mounted on a substrate by inserting the respective through-hole mount portions 53, 58, 63, 68, 73, and 77 of the pin-type terminal legs 43, 44, 45, 46, 47 and 48 of the terminals 43, 44, 45, 46, 47, and 48 into through holes of the substrate.

When the cable-side connector 2 is plugged into the board-side connector 3, the contact portions 8*d* and 9*d* of signal terminals 8 and ground terminals 44 on the cable-side connector 2 are brought into contact with the contact portions 50 and 65 of the first and second signal terminals 43 and 46 and the first and second ground terminals 44 and 47 on the board-side connector 3, respectively. At the same time, the side edges of shield terminals 10 on the cable-side connector 2 are brought into contact with the contact portions 60*b* and 75*b* of the first and second shield terminals 45 and 48 on the board-side connector 3.

According to the invention it is possible to make the impedance match thus preventing reflection by forming a microstrip line configuration between signal and ground terminals.

Furthermore, since the terminal legs 61 of the shield terminals 45 are brought in parallel and close to the terminal legs 51 of the signal terminals 44 on the board-side connector 3, it is possible to prevent crosstalk between signals.

In FIGS. 38–41, there is shown a board-side connector 3 according to another embodiment of the invention. This board-side connector 3 is different from the board-side connector 3 of FIGS. 21–23 in terms of the shape of the first shield terminal.

Figure 36:
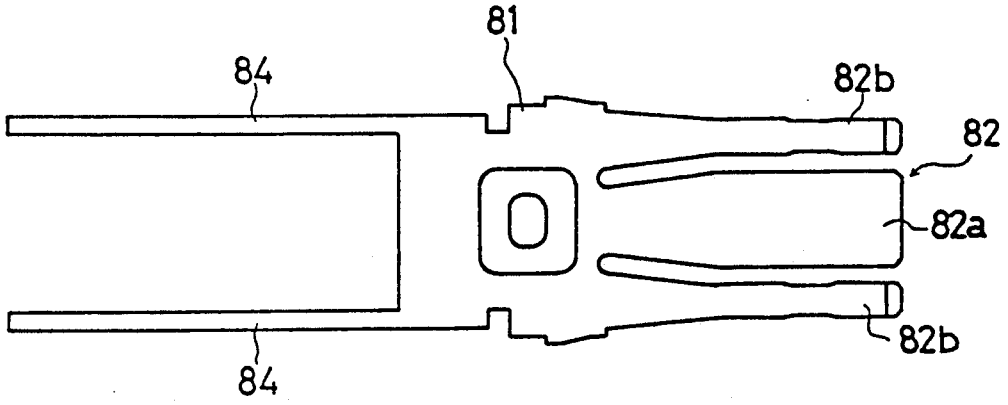
FIG. 36 is a top plan view of a second shield terminal of the board-side connector.
Figure 37:
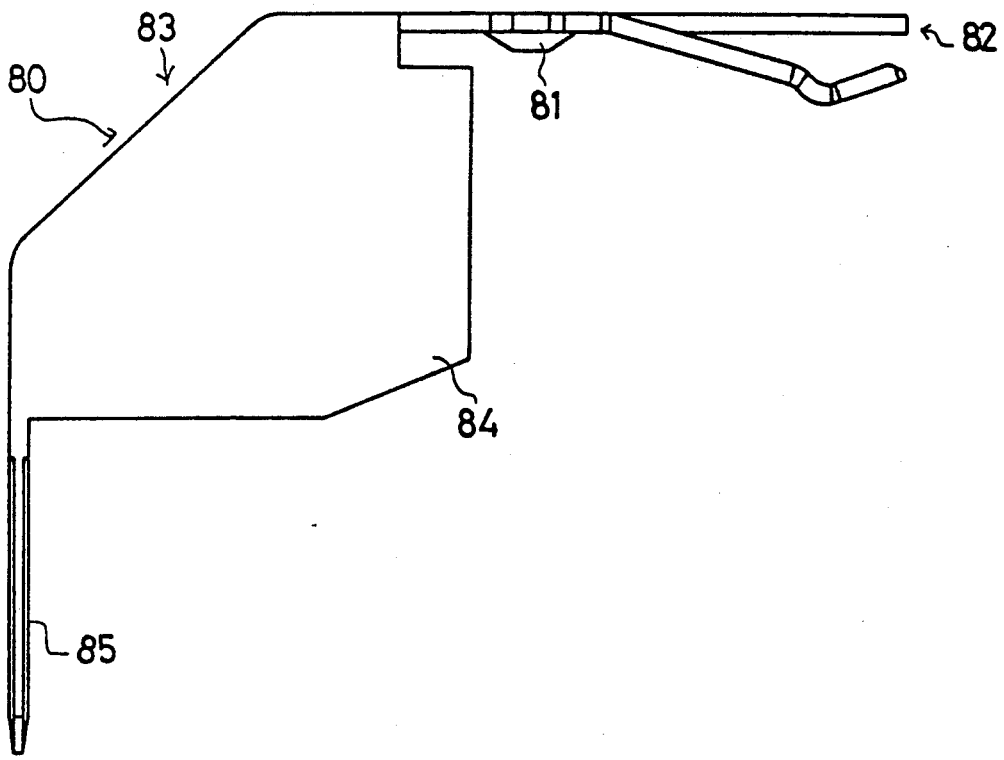
FIG. 37 is a side elevational view of the second shield terminal.
Figure 38:
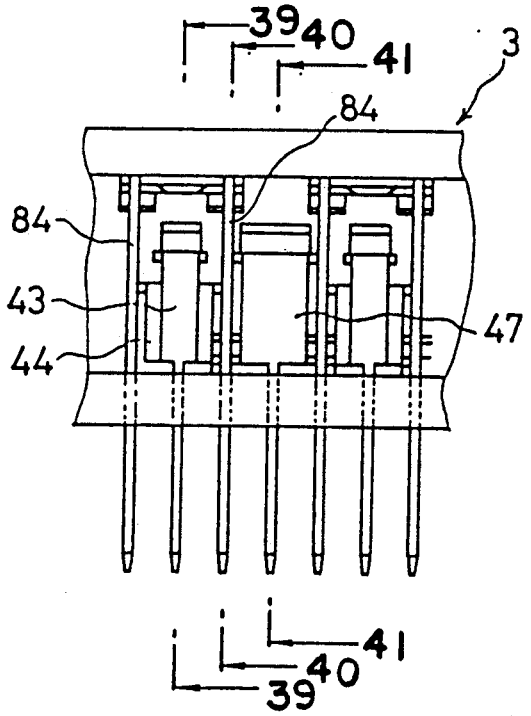
FIG. 38 is a rear elevational view of a part of a board-side connector according to another embodiment of the invention.
Figure 39:
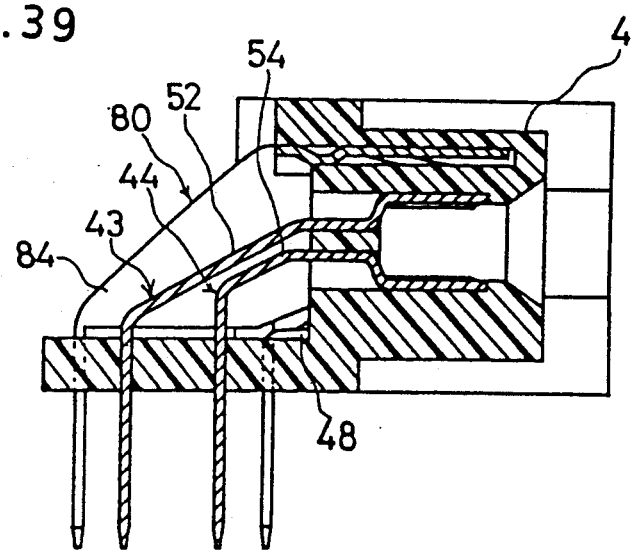
FIG. 39 is a sectional view taken along line 39—39 of FIG. 38.
Figure 40:
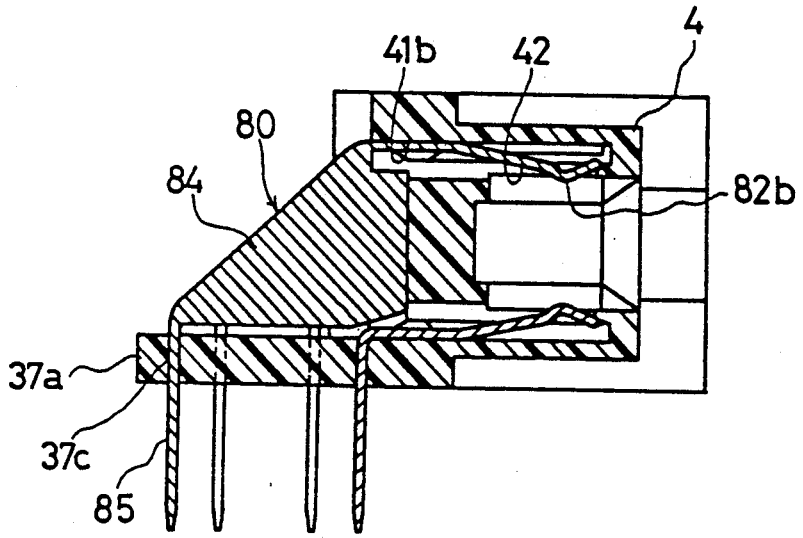
FIG. 40 is a sectional view taken along line 40—40 of FIG. 38.
Figure 41:
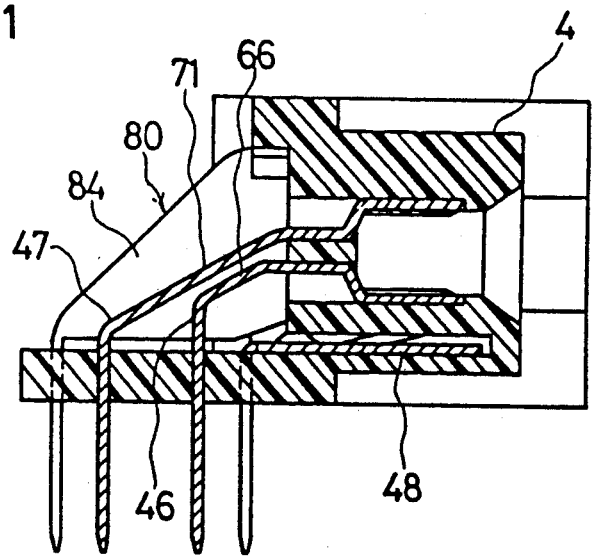
FIG. 41 is a sectional view taken along line 41—41 of FIG. 38.
Figure 42:
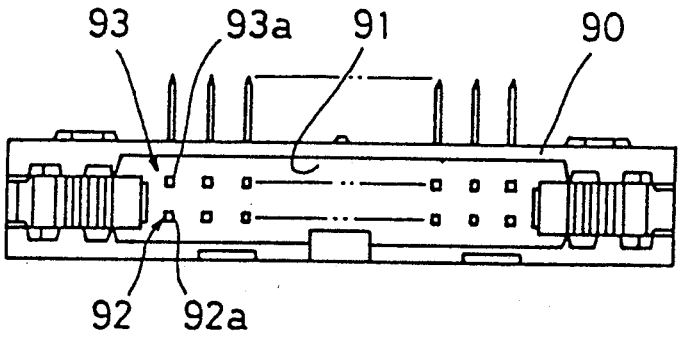
FIG. 42 PRIOR ART
FIG. 42 is a front elevational view of a conventional board-side connector of a coaxial ribbon cable connector.
Figure 43:
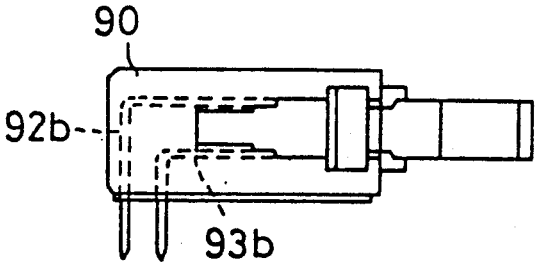
FIG. 43 PRIOR ART
FIG. 43 is a side elevational view of the conventional board-side connector.

In FIGS. 36 and 37, the shield terminal 80 has a press-fit portion 81; a contact portion 82 extending forwardly from the press-fit portion 81; and a terminal leg 83 extending rearwardly from the press-fit portion 81. The contact portion 82 is made up of a pair of contact members **82*b* formed on opposite sides of a retention member 82*a*. Each contact member 82*b* is bent in the base portion. The terminal leg 83 has a pair of parallel shield plates 84 extending downwardly in a plane perpendicular to the press-fit portion 81. Each shield plate 84 has a through-hole mount portion 85** extending downwardly from the lower edge thereof.

Like the above embodiment, the first and second signal terminals 43 and 46, the first and second ground terminals 44 and 73, and the second shield terminal 48 are press fitted into the insulating case 33. The shield terminal 80 is mounted in the insulating case 33 by press fitting the press-fit portion 81 into the shield terminal mount aperture **41*b* such that the through-hole mount portion 85 of the terminal leg 83 is inserted into the aperture 37*c* of the locator 37*a* while the contact members 82*b* are inserted into the terminal grooves 42 on opposite sides of the shield terminal mount aperture 41*b*. The shield plates 84 are disposed between the signal terminal 43 (47) and the ground terminal 44 (47**) above the locator to thereby prevent crosstalk between signals.

The terminal leg 51 of the first signal terminal 43 and the terminal leg 56 of the first ground terminal 44 form a strip line configuration in the sloped portions 52 and 54 while the terminal leg 66 of the second signal terminal 46 and the terminal leg 71 of the second ground terminal 47 form a microstrip line in the sloped portion 67 and 72 between signal and ground terminals to thereby make the impedance match and suppress reflection.

We claim:

1. A coaxial ribbon cable connector consisting of a cable-side connector and a board-side connector, said cable-side connector comprising:

an insulating case;

a plurality of signal terminals to which signal lines of a coaxial cable are to be connected;

a plurality of ground terminals to which drain lines of said cable are to be connected; and a plurality of shield terminals disposed between said signal terminals; and said board-side connector comprising:

an insulating case;

a plurality of signal terminals arranged within said insulating case for contact with said signal terminals of said cable-side connector;

a plurality of ground terminals arranged within said insulating case for contact with said ground terminals of said cable-side connector;

a plurality of shield terminals arranged within said insulating case for contact with said shield terminals of said cable-side connector; and terminal legs of said signal and ground terminals being arranged in parallel to form a microstrip line.

* * * * *